US012044098B2

(12) United States Patent
Hurtado et al.

(10) Patent No.: US 12,044,098 B2
(45) Date of Patent: Jul. 23, 2024

(54) STAGE CEMENTING COLLAR WITH CUP TOOL

(71) Applicant: Schlumberger Technology Corporation, Sugar Land, TX (US)

(72) Inventors: Jose Hurtado, Houston, TX (US); Mikhail Gotlib, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 56 days.

(21) Appl. No.: 17/755,883

(22) PCT Filed: Nov. 12, 2020

(86) PCT No.: PCT/US2020/060118

§ 371 (c)(1),
(2) Date: May 11, 2022

(87) PCT Pub. No.: WO2021/097017

PCT Pub. Date: May 20, 2021

(65) Prior Publication Data

US 2022/0381109 A1 Dec. 1, 2022

Related U.S. Application Data

(60) Provisional application No. 62/934,313, filed on Nov. 12, 2019.

(51) Int. Cl.

| | |
|---|---|
| ***E21B 33/14*** | (2006.01) |
| ***E21B 34/14*** | (2006.01) |
| ***E21B 47/06*** | (2012.01) |

(52) U.S. Cl.

CPC ..... *E21B 33/146* (2013.01); *E21B 34/14* (2013.01); *E21B 47/06* (2013.01); *E21B 2200/06* (2020.05)

(58) Field of Classification Search

CPC ..... E21B 33/146; E21B 34/14; E21B 7/06; E21B 2200/06

See application file for complete search history.

(56) References Cited

U.S. PATENT DOCUMENTS 3,598,183 A * 8/1971 Scott ..... E21B 41/00 166/305.1

3,789,926 A 2/1974 Henley et al.

(Continued)

FOREIGN PATENT DOCUMENTS

CN 201568013 U 9/2010
CN 105089529 A 11/2015

(Continued)

OTHER PUBLICATIONS

Koltypin, O. A. et al., (2014) Implement an Integrated approach at the completion of horizontal wells with multi-stage hydraulic franctur-ing in LLC RN-Yuganskneftegaz, Scientific and Technical Bulletin of OAO OC Rosneft, Appendix, issue 2, 2014, pp. 36-41.

(Continued)

*Primary Examiner* — Taras P Bemko
(74) *Attorney, Agent, or Firm* — Michael Wills, III

(57) ABSTRACT

A technique facilitates simplified cementing operations in a borehole with fewer trips downhole. The technique utilizes a cementing system having a stage cementing collar in combination with a cup tool. According to an embodiment, the stage cementing collar may comprise a collar body, a no-go connected to the collar body, and a port closure sleeve which serves as a valve positioned to close/open flow ports extending laterally through the collar body. The cup tool may be conveyed downhole on, for example, jointed pipe or coiled tubing, for engagement with the port closure sleeve.

(Continued)

The cup tool is used to shift the port closure sleeve between operational positions, e.g. from a port open to a port closed position.

20 Claims, 10 Drawing Sheets

(56) References Cited

U.S. PATENT DOCUMENTS 3,797,572 A * 3/1974 Mignotte ..... E21B 23/06 166/134
4,192,375 A * 3/1980 Maly ..... E21B 33/124 166/51
4,246,958 A 1/1981 Sagan et al.
4,669,541 A 6/1987 Bissonnette
5,038,862 A 8/1991 Giroux et al.
5,318,118 A 6/1994 Duell
5,348,089 A 9/1994 Brandell et al.
5,366,019 A * 11/1994 Brooks ..... E21B 23/006 166/387
5,443,124 A 8/1995 Wood et al.
5,711,372 A 1/1998 Stokley
5,890,537 A 4/1999 Lavaure et al.
6,098,710 A 8/2000 Rhein-Knudsen et al.
6,755,256 B2 6/2004 Murley et al.
7,063,152 B2 6/2006 Yeo et al.
7,069,992 B2 7/2006 Lewis et al.
7,073,599 B2 7/2006 Smith
7,284,619 B2 10/2007 Stokley et al.
7,373,980 B2 5/2008 Lewis et al.
7,413,020 B2 8/2008 Carter et al.
7,464,758 B2 12/2008 Yeo et al.
7,654,324 B2 2/2010 Chase et al.
7,669,653 B2 3/2010 Craster et al.
7,857,052 B2 12/2010 Giroux et al.
8,162,047 B2 4/2012 Chase et al.
8,215,404 B2 7/2012 Makowiecki et al.
8,439,113 B2 5/2013 Boyle
8,657,004 B2 2/2014 Zhou
8,800,655 B1 8/2014 Bailey
9,080,422 B2 7/2015 Melenyzer
9,856,714 B2 1/2018 Giroux
9,869,157 B2 1/2018 Sevadjian et al.
9,945,206 B2 4/2018 Zhou
9,970,258 B2 5/2018 Barannikow et al.
10,053,954 B2 8/2018 Stautzenberger et al.
10,352,140 B2 7/2019 Parlin et al.
10,378,311 B2 8/2019 Bocangel Calderon et al.
10,428,607 B2 10/2019 Zhou
2012/0090847 A1* 4/2012 Getzlaf ..... E21B 34/10 166/305.1
2013/0264054 A1 10/2013 East et al.
2015/0027706 A1* 1/2015 Symms ..... E21B 34/066 166/185
2015/0330180 A1* 11/2015 Barannikow ..... E21B 33/12 166/184
2017/0067313 A1* 3/2017 Connell ..... E21B 34/06
2017/0314365 A1* 11/2017 Ojong ..... E21B 33/165
2021/0164299 A1* 6/2021 Fong ..... E21B 17/046
2021/0238594 A1 8/2021 Parmar et al.

FOREIGN PATENT DOCUMENTS

CN 107975352 A 5/2018
RU 52087 U1 3/2006
RU 2492323 C1 9/2013
RU 2625126 C1 7/2017
WO 2017190010 A1 11/2017

OTHER PUBLICATIONS

International Search Report and Written Opinion issued in the PCT Application PCT/RU2018/000561, dated May 16, 2019 (6 pages).
Ashrafian et al., Improvement of Constructions for Bottom Holes, M. Nedra, 1987 (8 pages).
Pak M.S. et al., StingBlade Groundbreaking Technology, downloaded on Apr. 29, 2019 (5 pages).
International Search Report and Written Opinion issued in the PCT Application PCT/US2020/060118, dated Mar. 8, 2021 (11 pages).
International Preliminary Report on Patentability issued in the PCT Application PCT/RU2018/000561, dated Mar. 11, 2021 (6 pages).

* cited by examiner

STAGE CEMENTING COLLAR WITH CUP TOOL

CROSS-REFERENCE TO RELATED APPLICATION

The present document is based on and claims priority to U.S. Provisional Application Ser. No. 62/934,313 filed Nov. 12, 2019, which is incorporated herein by reference in its entirety.

BACKGROUND

In many well applications, a wellbore is drilled and casing is deployed along the wellbore. Cementing operations may be performed to place cement at desired locations along the casing. For example, cement slurry may be pumped down and forced into the annulus between the casing and the surrounding wellbore wall. Sometimes stage cementing collars are used for cementing intervals of casing, e.g. intervals of casing positioned above a casing shoe. However, current systems and techniques often involve additional drill out and cleaning trips downhole after performing the cementing operation. The additional trips downhole can be expensive and time-consuming.

SUMMARY

In general, a methodology and system are provided for facilitating simplified cementing operations in a borehole with fewer trips downhole. The technique utilizes a cementing system having a stage cementing collar in combination with a cup tool. According to an embodiment, the stage cementing collar may comprise a collar body, a no-go connected to the collar body, and a port closure sleeve which serves as a valve positioned to close/open flow ports extending laterally through the collar body. The cup tool may be conveyed downhole on, for example, jointed pipe or coiled tubing, for engagement with the port closure sleeve. The cup tool is used to shift the port closure sleeve between operational positions, e.g. from a port open to a port closed position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
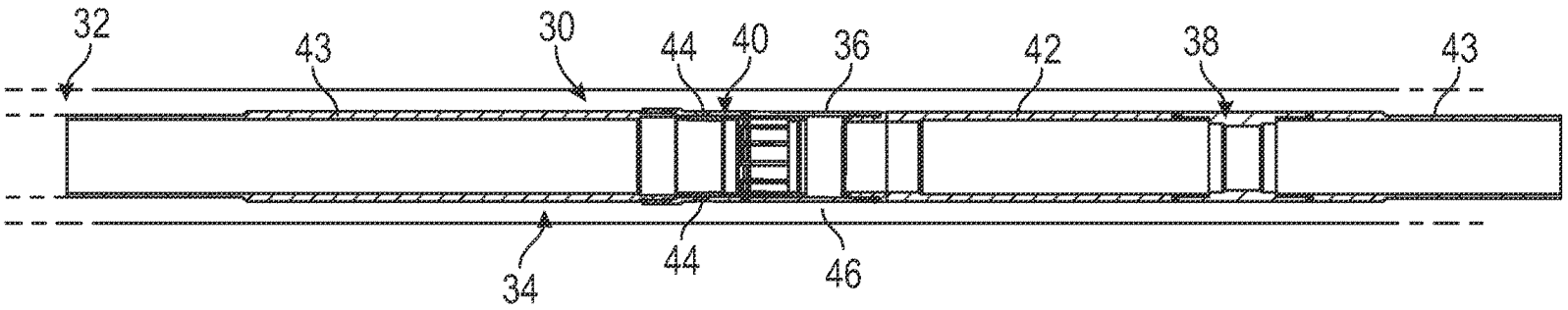
FIG. 1 is a cross-sectional illustration of an example of a stage cementing collar positioned in a borehole and having a port closure sleeve which may be operated as a valve to open or close flow ports extending between an interior and an exterior of the stage cementing collar, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system which facilitate simplified cementing operations in a borehole, e.g. a wellbore, with fewer trips downhole. The technique utilizes a cementing system having a stage cementing collar in combination with a cup tool. The cup tool may be conveyed downhole on a suitable conveyance, such as jointed pipe or coiled tubing, and may be releasably engaged with the stage cementing collar.

According to an embodiment, the stage cementing collar may comprise a collar body, a no-go connected to the collar body, and a port closure sleeve which serves as a valve positioned to close/open at least one flow port extending through a wall of the collar body. By way of example, the collar body may comprise a plurality of the flow ports, e.g. eight or more of the flow ports, which extend laterally through the collar body to enable fluid communication between an interior and an exterior of the stage cementing collar. The cup tool may be used to shift the port closure sleeve between operational positions, e.g. from a port open to a port closed position, to facilitate various cementing and pressure testing operations. By way of example, the port closure sleeve may be shifted between closed and open positions depending on the stage of the cementing and/or pressure testing operation.

It should be noted the cup tool may be used in combination with the no-go for work string positioning and as a port closure sleeve straddle. Additionally, the cup tool may be part of a work string and may have a removable pump down plug seat for receiving a pump down plug, e.g. a dart. By way of example, the pump down plug seat may be held in the cup tool by a shear member, e.g. shear screws. The cup tool also may comprise a ball seat for receiving a ball used to close off an internal through passage of the cup tool. In some embodiments, the ball seat may be located in the removable pump down plug seat.

As described in greater detail below, the stage cementing collar and the cup tool may be used in combination to facilitate desired cementing operations. Following a cementing operation, the pump down plug may be pumped downhole and along the internal passage of the cup tool to force cement slurry out into a surrounding annulus. The ball prevents flow of cement through a downhole end of the cup tool and thus ensures the cement is forced laterally out into the surrounding annulus. After the pump down plug is seated in the plug seat, cement removal may be verified via a pressure signal. Subsequently, sufficient pressure may be applied to shear the shear member and to release the pump down plug seat, thus enabling reverse circulation for removing excess cement. Removal of excess cement helps avoid additional trips downhole for drill out procedures.

The combination of components and features described herein provides a system and methodology with various abilities for enhancing and simplifying cementing operations. For example, the system provides an ability to receive a pump down cementing plug that displaces cement from the work string and seals inside the cup tool to provide an indication that the volume of cement has exited the cup tool. According to an embodiment, the pump down cementing plug may subsequently be sheared and displaced to reestablish pressure communication with the stage cementing collar and to thus enable a subsequent reverse circulation and pressure test.

Additionally, the system provides an ability to perform a pressure test after the cementing job is completed to confirm full closure and pressure integrity of the stage cementing collar. In some embodiments, a portion of the cup tool, e.g. a circulation sub, may be opened to establish circulation and to thus maintain control of the well while pulling the cup tool out to the surface after a cementing operation. The system also provides an ability to reverse circulate clean fluid down through an annulus between the cup tool and the stage cementing collar to remove excess cement. For example, excess cement remaining between upper and lower swab cups of the cup tool may be removed as the clean fluid is reverse circulated down past the upper swab cups and into an internal cup tool passage.

Referring generally to FIG. 1, an example of a stage cementing collar 30 positioned along a tubular string 32, e.g. a casing string, is illustrated as deployed in a borehole 34, e.g. a wellbore. In this embodiment, the stage cementing collar 30 comprises a collar body 36, a no-go 38 connected to the collar body 36, and a port closure sleeve 40. The no-go 38 may be connected to the collar body 36 via a tubular sub 42. Additional tubular subs 43 may be coupled to opposite ends of the collar body 36 and the no-go 38, as illustrated, via threaded engagement or other suitable engagement.

Furthermore, the collar body 36 may comprise at least one flow port 44 through which cement is discharged during a cementing operation to deliver cement into an annulus 46 between the tubular string 32 and the surrounding wall of borehole 34. By way of example, the at least one flow port 44 may extend laterally through a wall of the collar body 36 between an interior and exterior of the collar body 36 and may comprise a plurality of flow ports 44, e.g. eight or more flow ports. In FIG. 1, the port closure sleeve 40 is illustrated in a run-in-hole position in which the flow ports 44 are straddled, i.e. closed, by the port closure sleeve 40.

Figure 2:
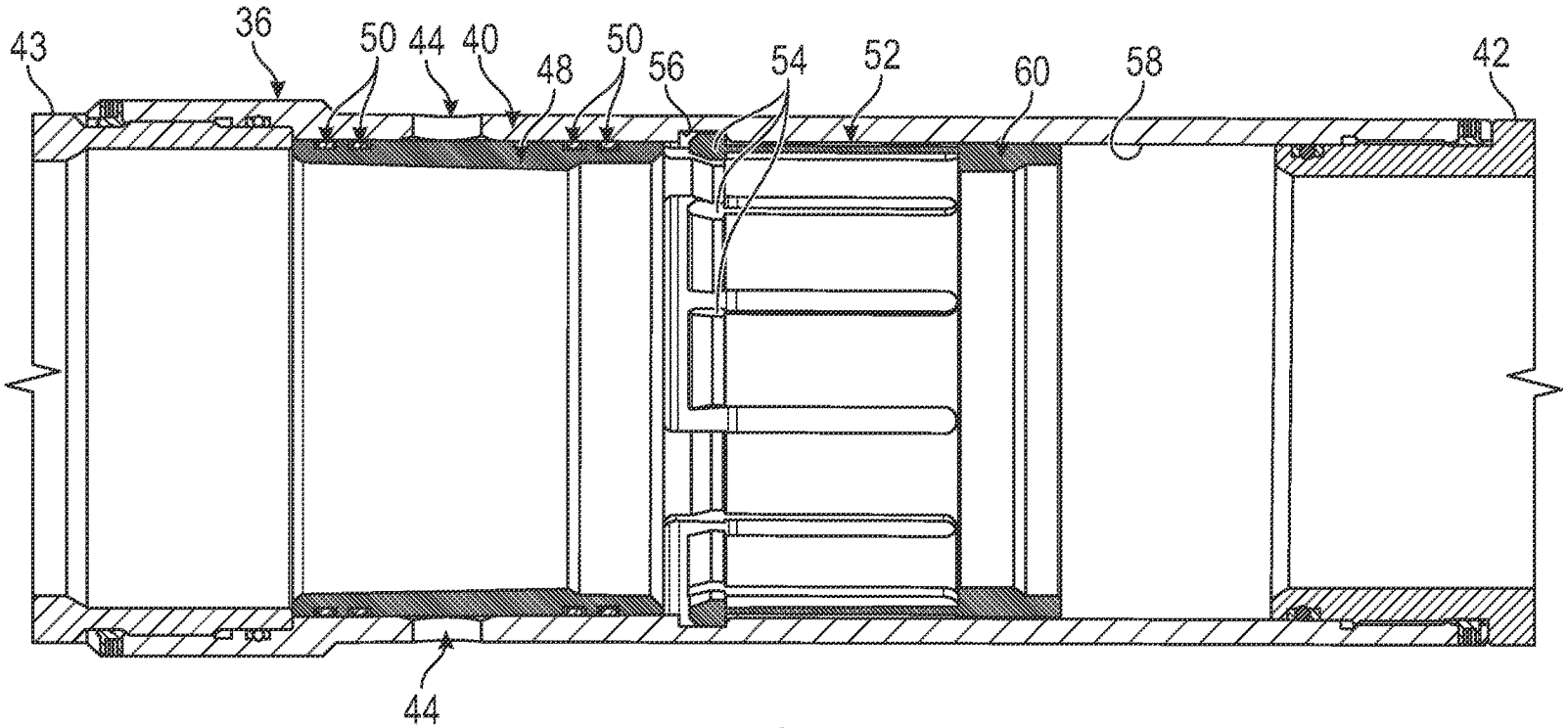
FIG. 2 is a cross-sectional illustration of an example of the port closure sleeve, according to an embodiment of the disclosure.

With additional reference to FIG. 2, the port closure sleeve 40 may comprise a sleeve section 48 onto which are positioned a plurality of seals 50, e.g. four bonded seals. The plurality of seals 50 may be located such that at least one seal is positioned on each side of the flow ports 44 when the port closure sleeve 40 is in a closed position as illustrated in FIG. 2. The port closure sleeve 40 also may comprise a collet section 52 having flexible collet fingers 54 oriented to enable interaction with a corresponding finger recess or recesses 56 formed along an internal surface 58 of collar body 36 (see FIG. 2). The collet fingers 54 may have expanded heads or various features constructed to releasably engage recess(s) 56.

In some embodiments, the collet section 52 also may comprise flexible detents received in corresponding detent recesses disposed along the internal surface 58 of collar body 36. By way of example, the flexible detents may be positioned to help hold the port closure sleeve 40 in an open flow position when the port closure sleeve 40 is shifted to enable flow through the flow ports 44. Additionally, the collet section 52 may comprise a shoulder 60. In FIGS. 1-2, the port closure sleeve 40 is illustrated as held in the closed run-in-hole position via heads of flexible collet fingers 54 secured in corresponding recess(s) 56. While in this position, the flexible detents would remain collapsed inwardly via internal surface 58.

Figure 3:
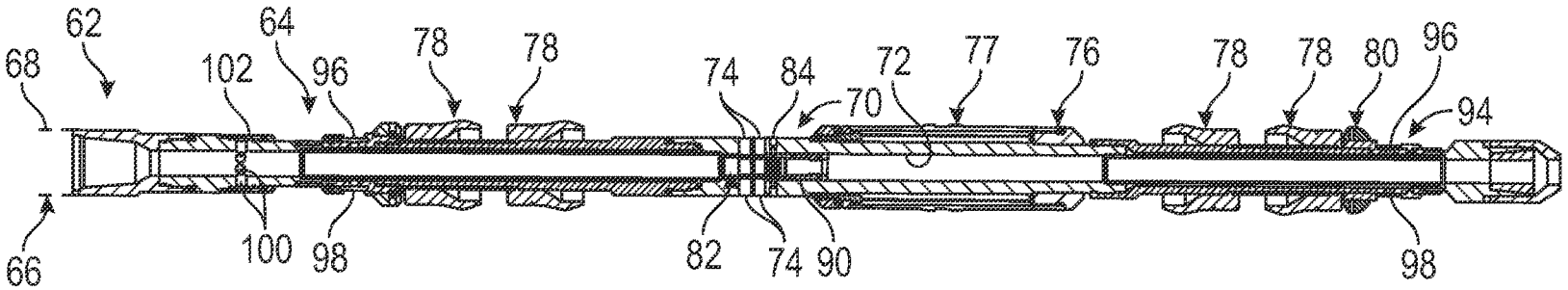
FIG. 3 is a cross-sectional illustration of an example of a cup tool assembly having a cup tool positioned along a tubing string formed with jointed pipe or coiled tubing, according to an embodiment of the disclosure.

Referring generally to FIG. 3, an example of a cup tool assembly 62 is illustrated as having a cup tool 64 positioned along a work string 66, e.g. tubing string. The work string 66 may comprise tubing 68 formed of, for example, jointed pipe or coiled tubing. In the embodiment illustrated, the cup tool 64 comprises a cup tool body 70 having an internal passage 72 and at least one cup tool port 74 extending between the internal passage 72 and an exterior of the cup tool 64. By way of example, a plurality of lateral cup tool ports 74 may be positioned about the cup tool body 70 to enable fluid flow to and from the internal passage 72.

In the illustrated example, the cup tool 64 further comprises a collet member 76 mounted on the cup tool body 70 and oriented for releasable engagement with the port closure sleeve 40. The collet member 76 may comprise various types of engagement features 77 oriented for engagement with port closure sleeve 40 to open and close the port closure sleeve 40 via linear movement of cup tool 64. For example, engagement features 77 may be constructed to releasably engage shoulder 60 of port closure sleeve 40. The cup tool 64 also may comprise a plurality of swab cups 78 extending from the cup tool body 70 on both sides of the collet member 76. By way of example, two or more elastomeric swab cups 78 may be positioned on each of an uphole side and a downhole side of the collet member 76. As illustrated, the cup tool 64 also may comprise a no-go feature 80, e.g. a no-go ring, positioned for engagement with no-go 38 of the stage cementing collar 30.

Figure 4:
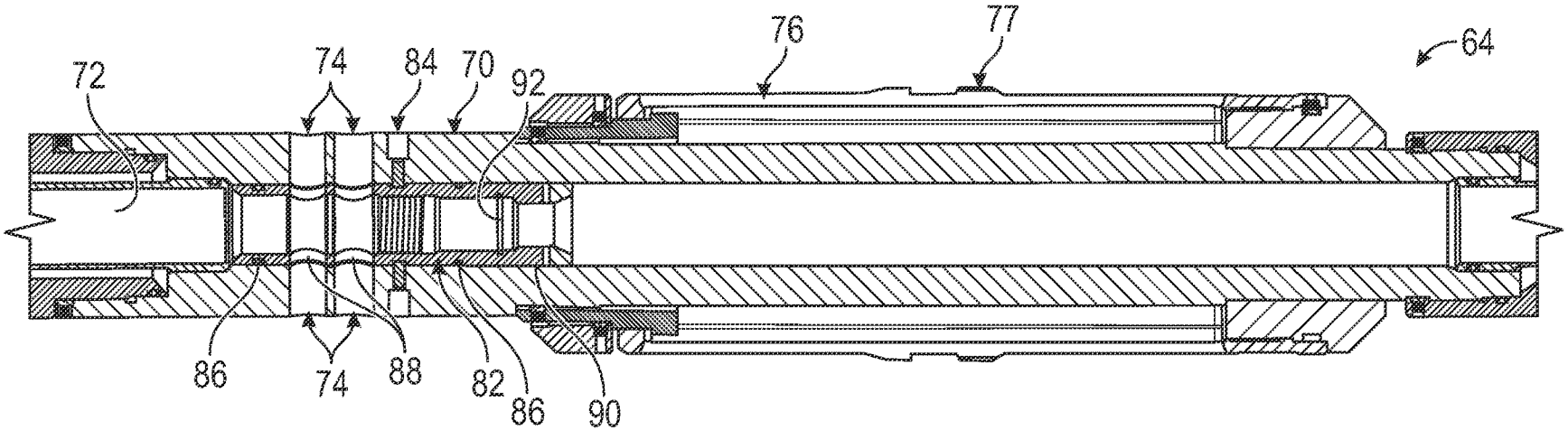
FIG. 4 is a cross-sectional illustration of a portion of the cup tool, according to an embodiment of the disclosure.

With additional reference to FIG. 4, the cup tool 64 also may comprise a releasable seat 82 for receiving a pump down plug, e.g. a pump down dart. The releasable seat 82 may be releasable via a shear member 84, e.g. a plurality of shear screws. In the illustrated example, the releasable seat 82 comprises seals 86 arranged to seal with the surrounding internal wall surface of cup tool body 70 on opposite sides of cup tool ports 74. As illustrated, the releasable seat 82 also may have lateral openings 88 in fluid communication with cup tool ports 74. The releasable seat 82 may further comprise an internal ball seat 90 and a ball retention feature 92, e.g. a retention ring, for securing a ball in sealing engagement with ball seat 90. However, the internal ball seat 90 could be located at other positions within the cup tool 64.

According to some embodiments, the cup tool 64 also may comprise a fluid bypass 94 comprising a longitudinal passage or passages extending through cup tool body 70 between bypass ports 96. The bypass ports 96 may be covered by appropriate screens 98. Fluid bypass 94 may be used to facilitate deployment of cup tool 64 by allowing fluid to bypass the swab cups 78 during, for example, movement of cup tool 64 downhole into stage cementing collar 30. Additionally, the cup tool 64 may comprise circulation ports 100 which are initially blocked by a circulation port sleeve 102. However, when the cup tool 64 is pulled out of hole, the circulation port sleeve 102 may be shifted to expose circulation ports 100 to enable a desired circulation flow as described in greater detail below.

Figure 5:
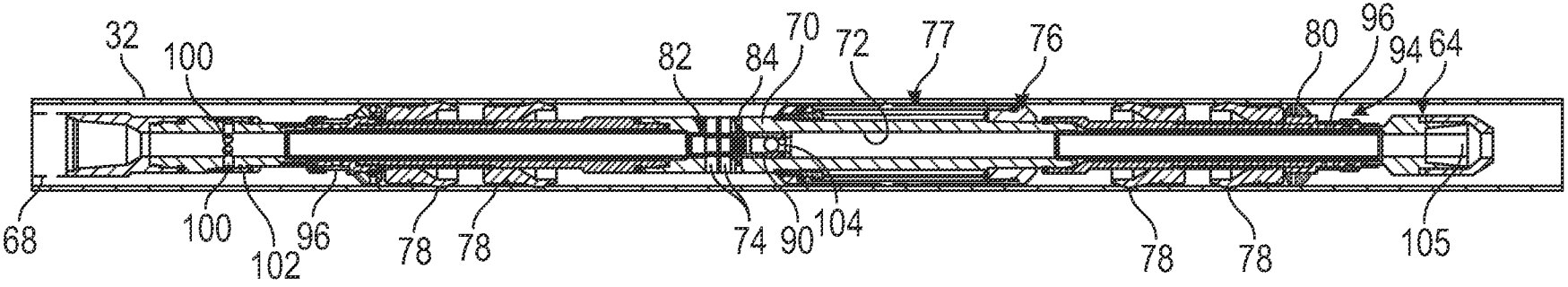
FIG. 5 is a cross-sectional illustration of a cup tool positioned in a tubular string including the stage cementing collar, according to an embodiment of the disclosure.
Figure 6:
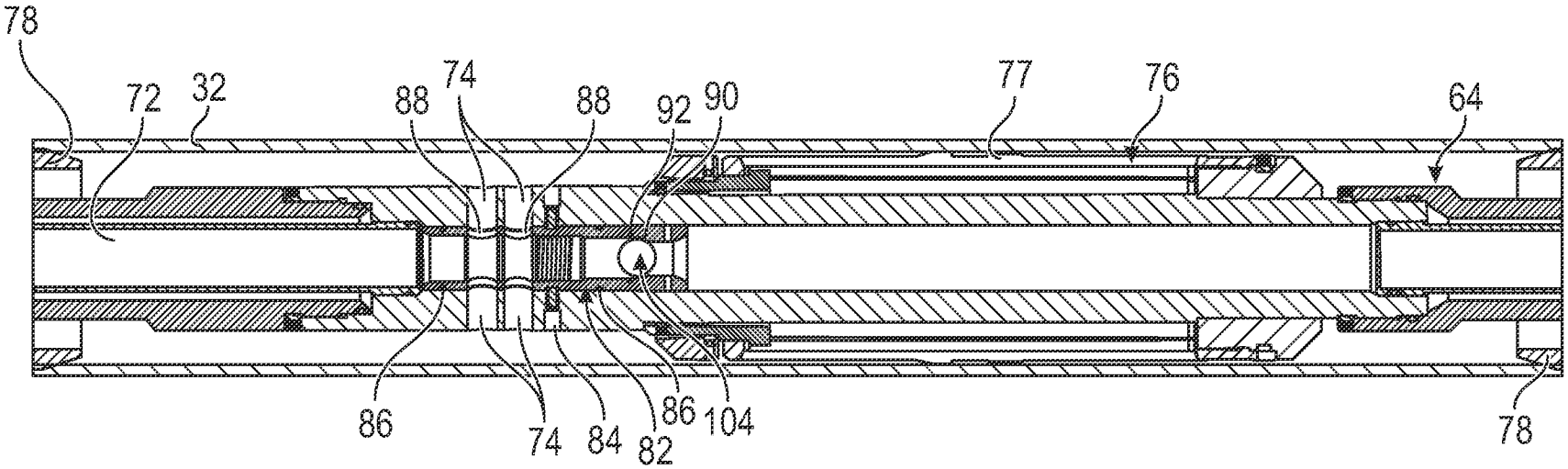
FIG. 6 is a cross-sectional view of a portion of the cup tool positioned in a tubular string including the stage cementing collar, according to an embodiment of the disclosure.

In an operational example, the cup tool 64 is run from the surface on jointed pipe/coiled tubing 68 while the port closure sleeve 40 is in a closed position. A ball 104 may then be moved down through the tubing 68 along the internal passage 72 and into sealing engagement with ball seat 90, as illustrated in FIGS. 5 and 6. The ball retention feature 92 may be used to secure the ball 104 against ball seat 90. Additionally, proper landing of the ball 104 can be recognized by a pressure spike at the surface to confirm seating of the ball 104.

It should be noted that in some wells, e.g. highly deviated wells, it may be difficult to pump ball 104 down through the well and into engagement with the ball seat 90. Accordingly, some embodiments may employ other mechanisms for blocking flow in a manner to facilitate a cementing operation. For example, a lower sub or other suitable component of cup tool 64 may be constructed with a burst/rupture disc 105 (as illustrated via dashed lines in FIG. 5). The disc 105 is constructed to break upon application of a pre-determined pressure. In this type of embodiment, the cup tool 64 is run in a "plugged" configuration with no axial flow therethrough from the surface down to the stage cementing collar 30. This type of configuration allows use of ball 104 to be avoided in certain types of wells, e.g. highly deviated wells.

Figure 7:
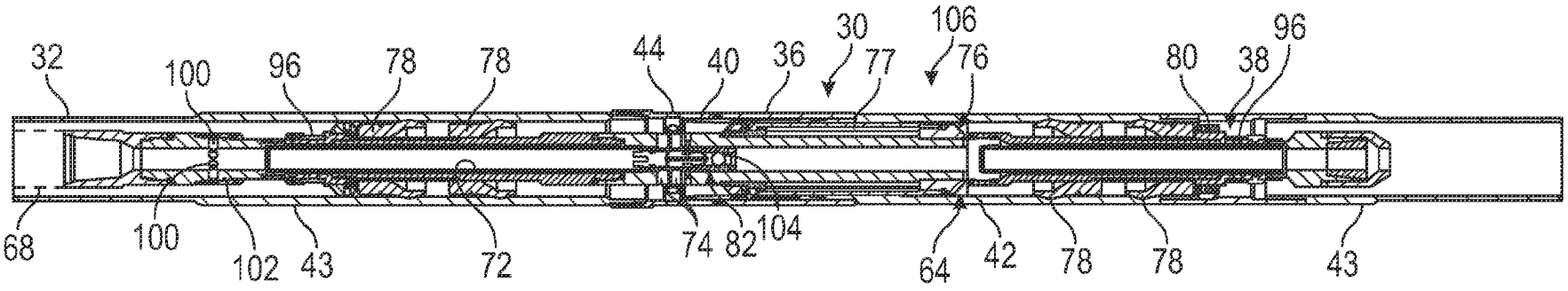
FIG. 7 is a cross-sectional illustration of an example of an overall cementing system having a cup tool positioned in the stage cementing collar after shifting the port closure sleeve to an open flow position, according to an embodiment of the disclosure.

Referring again to FIG. 6, movement of the cup tool 64 into stage cementing collar 30 may be continued until the collet member 76 engages port closure sleeve 40, e.g. until engagement feature 77 is moved into engagement with shoulder 60 of port closure sleeve 40. Once engaged, continued linear movement of cup tool 64 causes the port closure sleeve 40 to shift to an open flow position, as illustrated in FIG. 7. Effectively, combination of the cup tool 64 and the stage cementing collar 30 provides a useful cementing system 106 which may be used to limit or avoid additional trips downhole by enabling cementing and cleanout during the single trip downhole.

Figure 8:
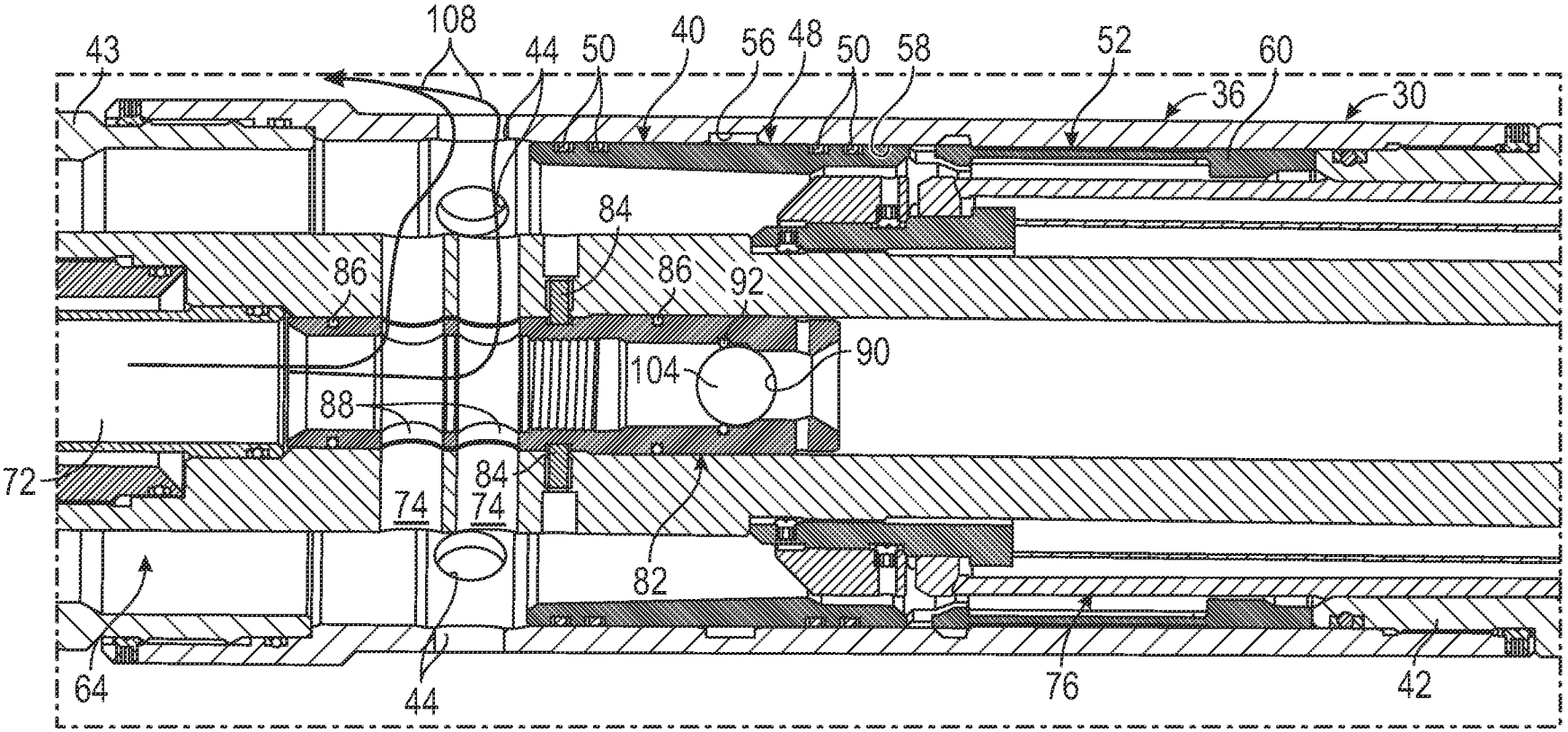
FIG. 8 is a cross-sectional illustration of an example of the cup tool positioned in the stage cementing collar during a cementing operation, according to an embodiment of the disclosure.

During shifting of the port closure sleeve 40 to the open position, the axial force applied to the port closure sleeve 40 via the cup tool 64 overcomes the spring force of flexible collet fingers 54. This causes the port closure sleeve 40 to shift positions until the no-go ring 80 of the cup tool 64 bottoms out against the no-go 38 of stage cementing collar 30. This shifting effectively moves the port closure sleeve 40 to an open position in which flow ports 44 are open for flow. As illustrated in FIGS. 7 and 8, the cup tool ports 74 and the flow ports 44 are open and in fluid communication to enable fluid flow between internal passage 72 and the annulus 46 surrounding stage cementing collar 30. At this stage, the internal passage 72 remains closed to flow downhole via ball 104 sealingly engaged with ball seat 90.

With cup tool ports 74 and flow ports 44 open to flow, cement in the form of cement slurry may be pumped down through tubing string 68, through internal passage 72, out through cup tool ports 74 and flow ports 44, and into annulus 46 surrounding the stage cementing collar 30 as illustrated by arrows 108 in FIG. 8. The swab cups 78 prevent the cement slurry from undue migration in the annular region between the cup tool 64 and the stage cementing collar 30. In some embodiments, returns from the cementing operation may be checked at the surface.

Figure 9:
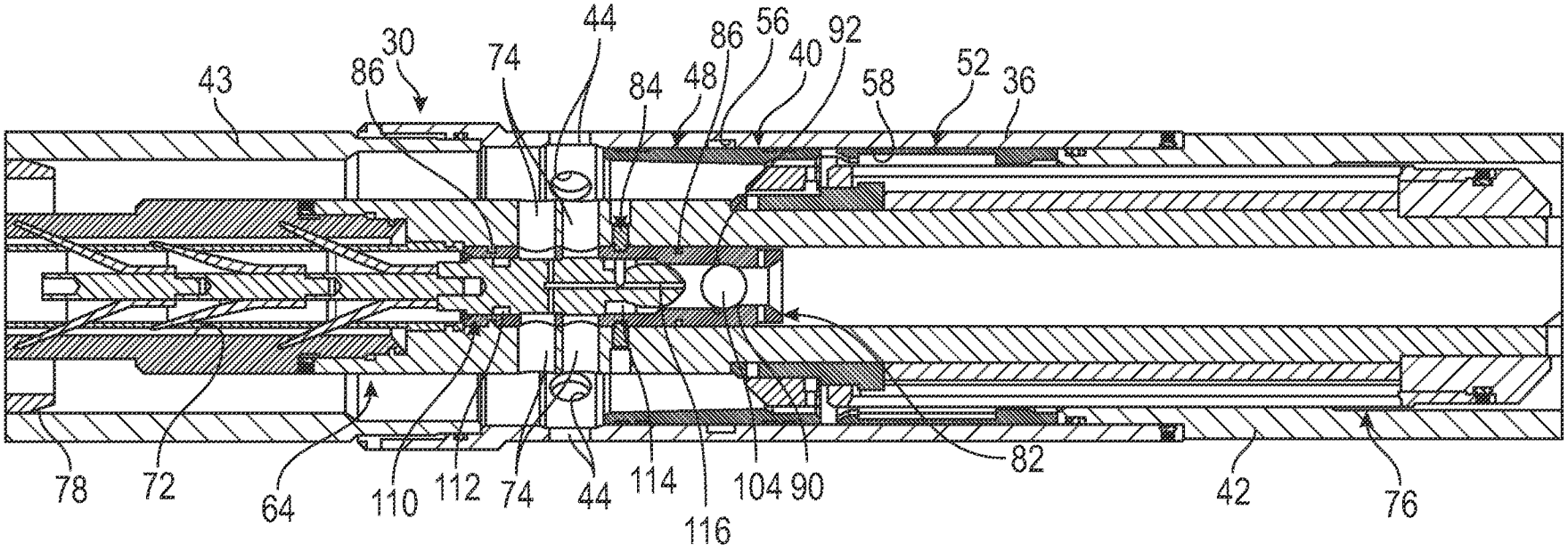
FIG. 9 is a cross-sectional illustration of an example of the cup tool positioned in the stage cementing collar and of a landed pump-down plug closing off cup tool ports, according to an embodiment of the disclosure.

The cement may be followed by a pump down plug 110, e.g. a pump down dart, which is pumped down to force cement out of the cup tool 64. The pump down plug 110 moves down along internal passage 72 until it lands and locks in releasable seat 82, as illustrated in FIG. 9. Once landed on seat 82, the pump down plug 110 blocks further flow of fluid through cup tool ports 74 via, for example, an appropriately placed plug seal or seals 112. In some embodiments, the pump down plug 110 also may comprise a plug lock ring 114. The pump down plug 110 may further include suitable passageways 116 oriented to drain fluid above the ball 104 as the pump down plug 110 is landed in releasable plug seat 82. The closure of cup tool ports 74 also can be used to create a pressure signal at the surface which indicates that the pump down plug 110 has landed and that the cement has been fully forced out of the cup tool 64.

Figure 10:
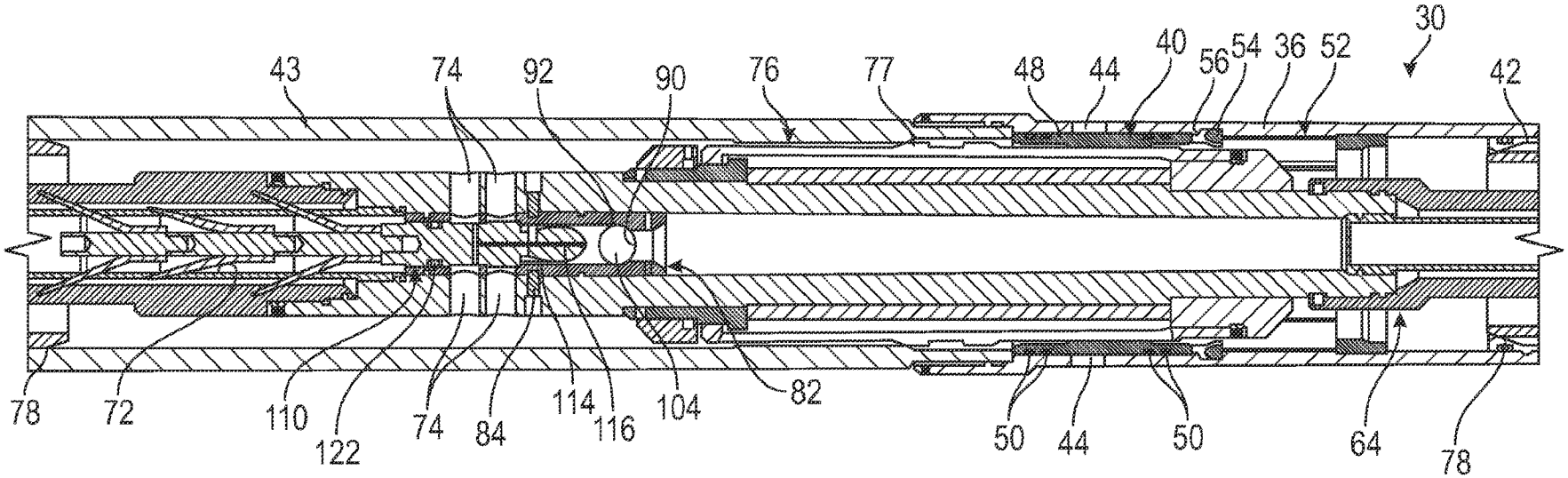
FIG. 10 is a cross-sectional illustration showing the port closure sleeve when the port closure sleeve is shifted back to a closed position, according to an embodiment of the disclosure.

Following landing of pump down plug 110, the cup tool 64 may be shifted, e.g. picked up via tubing string 68, such that collet member 76 shifts the port closure sleeve 40 in an uphole direction to a closed position, as illustrated in FIG. 10. Continued lifting of cup tool 64 disengages the collet member 76 from the port closure sleeve 40. In the closed position, the sleeve section 48 of port closure sleeve 40 again blocks flow through flow ports 44. The port closure sleeve 40 may be held in this position via the flexible collet fingers 54 which snap into engagement with the corresponding collet recesses 56, as further illustrated in FIG. 10.

Figure 11:
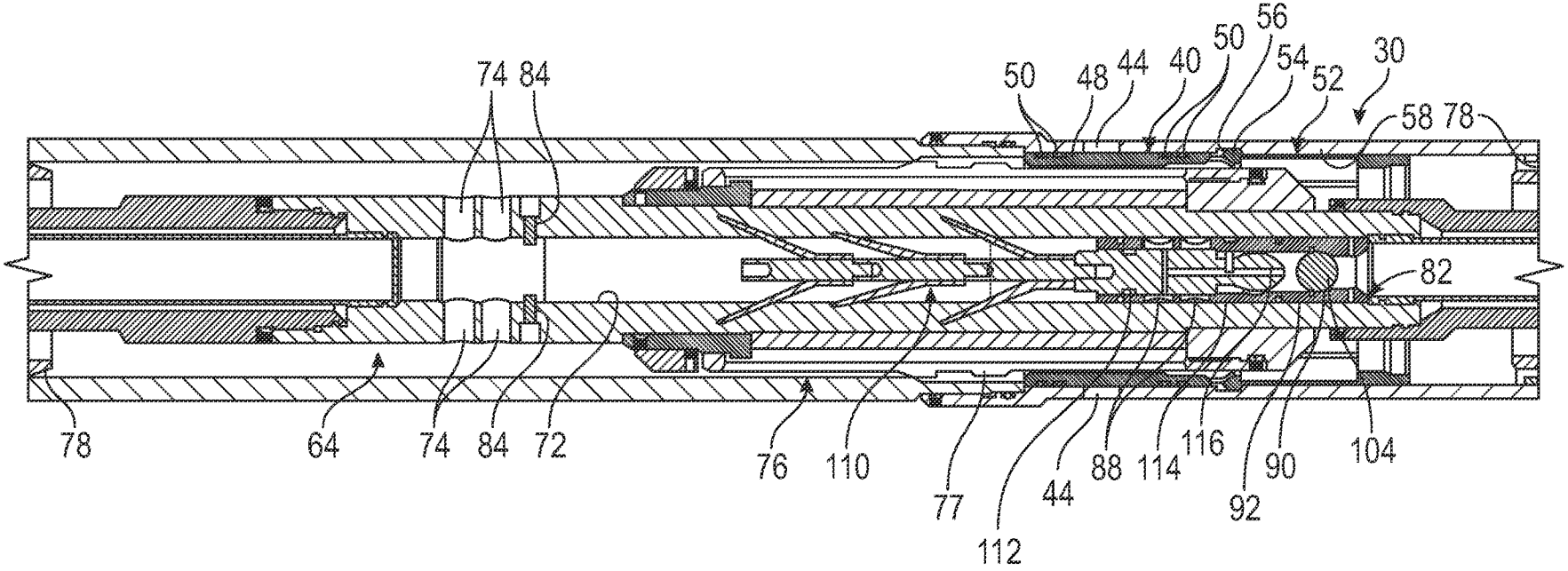
FIG. 11 is a cross-sectional illustration of an example of the cup tool positioned in the stage cementing collar and of the landed pump-down plug which has been sheared and shifted down, according to an embodiment of the disclosure.

At this stage, pressure along internal passage 72 may be increased to release the releasable seat 82, e.g. to shear the shear member 84. This allows the pump down plug 110 and the seat 82 to be moved in a downhole direction and to reopen the cup tool ports 74, as illustrated in FIG. 11. Once the pump down plug 110 has been displaced and the cup tool ports 74 are reopened, pressure may again be applied down through the tubing string 68 so as to pressure test the port closure sleeve 40, e.g. to make sure pressure is not escaping out through ports 44.

Figure 12:
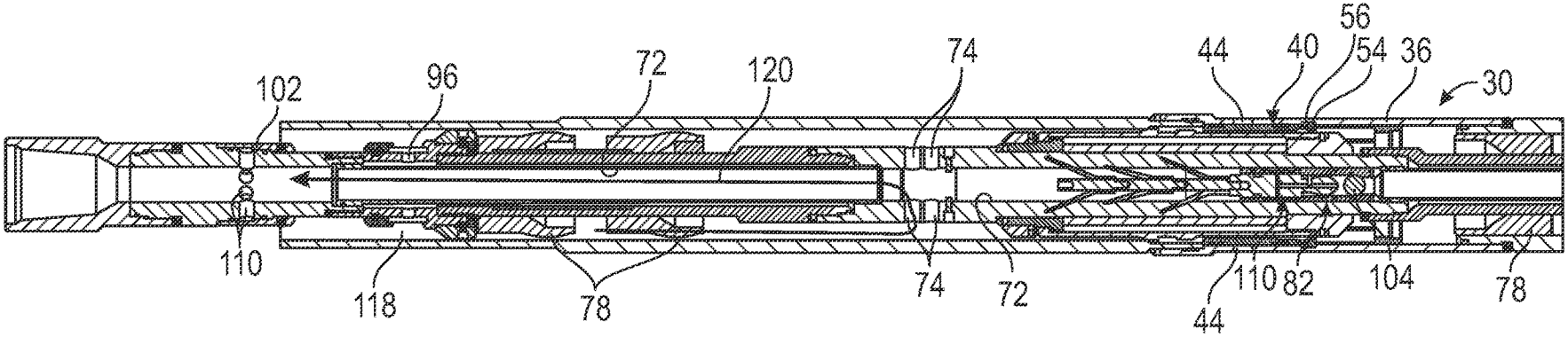
FIG. 12 is a cross-sectional illustration of an example of the cup tool positioned in the stage cementing collar during reverse circulation, according to an embodiment of the disclosure.

Following the pressure test, clean fluid may be pumped down through an annulus 118 between the cup tool 64 and the surrounding stage cementing collar 30 as indicated by arrow 120 in FIG. 12. The clean fluid 120 may be forced under pressure past the upper swab cups 78 so as to wash away any remaining cement. The flow of clean fluid 120 with any remaining cement moves through cup tool ports 74 and into internal passage 72 for return to the surface. This reverse circulation can be continued until the desired cleaning is achieved. After reverse circulation, an additional pressure test or pressure tests of the port closure sleeve 40 may again be conducted by pressuring up the tubing string 68.

Figure 13:
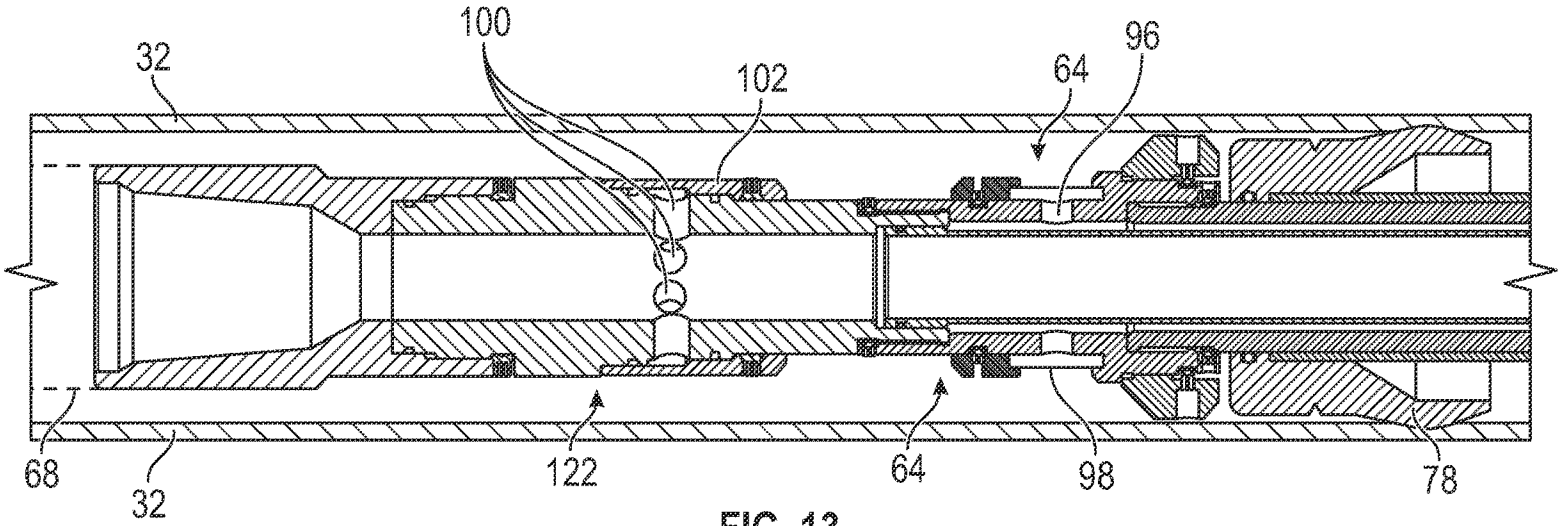
FIG. 13 is a cross-sectional illustration of an example of a portion of the cup tool having a circulation sub which may be opened to facilitate pulling the cup tool out of hole while pumping clean fluid to ensure well control, according to an embodiment of the disclosure.
Figure 14:
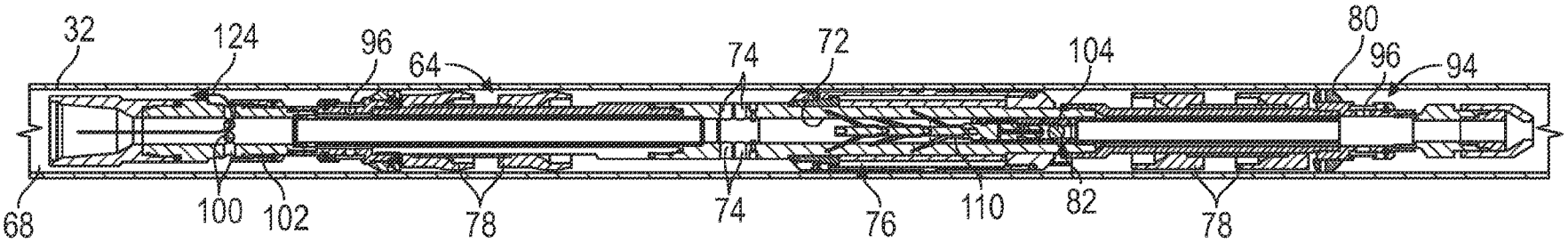
FIG. 14 is a cross-sectional illustration of an example of a portion of the cup tool in which the circulation sub has been shifted to an open position during pulling out of hole, according to an embodiment of the disclosure.

Once the reverse circulation is completed, sufficient pressure may be applied down through tubing string 68 so as to shift circulation port sleeve 102 of a corresponding circulation sub 122 from a closed position (see FIG. 13) to an open position as illustrated in FIG. 14. It should be noted the circulation sub 122 functions to eliminate wet pipe when tripping the cup tool 64 out of hole while also providing an ability to circulate fluid for well control. While the circulation sub 122 is in the open position, for example, circulation fluid may be flowed through circulation ports 100. In some embodiments, the cup tool 64 is picked up to a position above the stage cementing collar 30 and then sufficient pressure is applied through tubing string 68 to shear and open the circulation port sleeve 102 of circulation sub 122. At this stage, the cup tool 64 may be pulled out of hole while circulating fluid down and out through circulation sub 122, as indicated by arrow 124 in FIG. 14.

It should be noted the stage cementing collar 30 and the cup tool 64 may be constructed in various sizes and configurations. Additionally, each of these components of the overall cementing system 106 may utilize various engagement features, seals, flow port arrangements, flow passages, and/or other features to enable the desired operation. Additionally, the stage cementing collar 30 and the cup tool 64 may be deployed downhole and operated via a variety of casing, tubing strings, and/or other conveyances. Various additional testing, cleaning, and/or other operations may be combined with the cementing operations according to the parameters of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

running downhole into a borehole a stage cementing collar having a collar body, a no-go connected to the collar body, and a port closure sleeve positioned to selectively close off ports extending laterally through the collar body;

conveying a cup tool into the stage cementing collar until a collet member of the cup tool engages the port closure sleeve;

using the cup tool to shift the port closure sleeve until the ports are in an open position;

pumping cement down through the cup tool, out through cup tool ports, and then out through the ports in the collar body to a downhole annulus;

moving a pump down plug to a landed position in the cup tool, after pumping the cement, to seal off the cup tool ports and thus provide an indication the cement has been removed from the cup tool;

shifting the port closure sleeve to again close off the ports with the cup tool; and displacing the pump down plug to open up the cup tool ports for reestablishing pressure communication with the stage cementing collar.

2. The method as recited in claim 1, further comprising conducting the subsequent pressure test to confirm closure of the ports and pressure integrity of the stage cementing collar.

3. The method as recited in claim 1, further comprising reverse circulating a clean fluid down through an annulus between the stage cementing collar and the cup tool, in through the cup tool ports, and up through an internal passage of the cup tool to carry remaining cement to the surface.

4. The method as recited in claim 3, further comprising conducting an additional pressure test after reverse circulating the clean fluid.

5. The method as recited in claim 3, wherein reverse circulating the clean fluid comprises pumping the clean fluid past swab cups of the cup tool.

6. The method as recited in claim 1, further comprising holding the port closure sleeve in a position closing off the ports by utilizing collet fingers engaged with an interior surface of the collar body.

7. The method as recited in claim 1, wherein using the cup tool to shift the pressure closure sleeve comprises moving the cup tool linearly until it bottoms out against the no-go.

8. The method as recited in claim 1, further comprising using circulation ports to facilitate pulling the cup tool out of hole.

9. The method as recited in claim 1, further comprising positioning a ball in a ball seat of the cup tool to facilitate a cementing operation and application of pressure.

10. The method as recited in claim 1, further comprising using a burst disc positioned along an internal passage of the cup tool to facilitate a cementing operation and application of pressure.

11. The method as recited in claim 1, wherein shifting the port closure sleeve to again close off the ports comprises lifting the cup tool while it is coupled to the pressure closure sleeve.

12. The method as recited in claim 1, wherein displacing the pump down plug comprises applying pressure until a shear member is sheared to release the pump down plug.

13. A system, comprising:

a stage cementing collar having a collar body, a no-go connected to the collar body, and a port closure sleeve positioned to selectively close off ports extending laterally through the collar body; and a cup tool configured for releasable engagement with the stage cementing collar, the cup tool comprising a cup tool body having an internal passage in communication with lateral cup tool ports, a collet member positioned about the cup tool body for engagement with the port closure sleeve, swab cups oriented to engage an internal surface of the stage cementing collar, and a releasable seat for receiving a dart and holding the dart in a position blocking flow through the cup tool ports, the cup tool being selectively shiftable to move the port closure sleeve between positions blocking flow through the collar ports and allowing flow through the collar ports to accommodate a cementing operation.

14. The system is illustrated in claim 13, where the port closure sleeve comprises a plurality of seals oriented to sealably engage the internal surface of the collar body.

15. The system as recited in claim 14, wherein the port closure sleeve comprises a plurality of flexible collet fingers oriented to engage the internal surface of the collar body.

16. The system as recited in claim 15, wherein the port closure sleeve comprises a shoulder positioned to engage the collet member of the cup tool in a manner which enables linear movement of the cup tool to shift the port closure sleeve between operational positions.

17. The system as recited in claim 13, wherein the releasable seat further comprises a ball seat for receiving a ball to provide a pressure seal along the internal passage.

18. The system as recited in claim 17, wherein the releasable seat is releasably secured in the cup tool via a shear member.

19. The system as recited in claim 18, wherein the shear member comprises a plurality of shear screws.

20. The system as recited in claim 17, wherein a ball retention feature is positioned to hold the ball against the ball seat.

* * * * *